US007416334B2

(12) United States Patent
Sundaram

(10) Patent No.: US 7,416,334 B2
(45) Date of Patent: Aug. 26, 2008

(54) APPARATUS FOR CONTROLLING RADIATION IN A RADIATION GENERATOR

(75) Inventor: Senthil Kumar Sundaram, Moraj (IN)

(73) Assignee: General Electric Company, Schenectady, NY (US)

( * ) Notice: Subject to any disclaimer, the term of this patent is extended or adjusted under 35 U.S.C. 154(b) by 57 days.

(21) Appl. No.: 11/465,571

(22) Filed: Aug. 18, 2006

(65) Prior Publication Data

US 2008/0043918 A1 Feb. 21, 2008

(51) Int. Cl.
*H01J 35/16* (2006.01)

(52) U.S. Cl. ..... 378/203; 378/117; 378/142

(58) Field of Classification Search ..... 378/101, 378/117, 119, 142, 203
See application file for complete search history.

(56) References Cited

U.S. PATENT DOCUMENTS

| | | | | |
|---|---|---|---|---|
| 4,748,104 | A | 5/1988 | Ferrier et al. | |
| 5,682,412 | A * | 10/1997 | Skillicorn et al. | 378/98.6 |
| 6,619,842 | B1 | 9/2003 | Artig et al. | |
| 6,888,922 | B2 * | 5/2005 | Schaefer et al. | 378/131 |
| 2003/0081727 | A1 | 5/2003 | Kandankumerath et al. | |
| 2005/0018817 | A1 | 1/2005 | Oettinger et al. | |

* cited by examiner

*Primary Examiner*—Jurie Yun

(57) ABSTRACT

An apparatus for controlling the transmission of electromagnetic radiation generated in a radiation generator is provided. The apparatus includes a printed circuit board having a substrate layer and at least one medium layer bound to the substrate layer. The printed circuit board is configured to control the transmission of the electromagnetic radiation.

17 Claims, 4 Drawing Sheets

APPARATUS FOR CONTROLLING RADIATION IN A RADIATION GENERATOR

BACKGROUND OF THE INVENTION

The subject matter described herein generally relates to a radiation generator and more particularly to a radiation control apparatus configured to control radiation generated in a radiation generator.

Various types of radiation generators have been developed so as to generate electromagnetic radiation. The electromagnetic radiation thus generated can be utilized for various purposes including medical imaging. One such example of a radiation generator is an X-ray generator. A typical X-ray generator generally comprises an X-ray tube for generating electromagnetic radiation (For example, X-rays), a power supply circuit configured to energize the X-ray tube in a conventional manner so as to emit X-rays through a port and toward a target. Radiation shielding is provided around the X-ray port in order to prevent the X-rays from undesirably reaching the operator. Radiation shielding is usually performed with a shielding material that comprises a heavy metal material such as lead. The shielding material is mixed with an insulation to provide radiation shielding.

The power supply circuit of a conventional X-ray generator generally includes a high voltage conductor configured to supply high voltage power so as to energize the X-ray tube. In one scenario, the radiation shield is placed between the X-ray tube and the power supply circuit, and the high voltage conductor is passed through the radiation shield requiring a use of insulating material along with the shielding material. A high electrical stress exists between the high voltage conductor and the shielding material of the radiation shield as the conductor carrying a high voltage is placed at a close proximity to the shielding material maintained at a ground potential. The positioning and dimensional control of the shielding material is critical in keeping the electrical stress at a safe value. One drawback of these certain known radiation shields is the difficulty in controlling the dimensional variations and positioning of the lead material particularly when used on or along an insulating surface. This difficulty in controlling the placement of the lead material increases opportunities of undesired electrical arcing of the high voltage electrical power causing failure of the X-ray generator.

Another drawback of conventional radiation shields is the technical difficulty associated with grounding the heavy metal material such as lead when used on or along with insulating surface. The soldering process for grounding the lead is generally performed by exposing a part of the lead material to insulating oil often used in the X-ray generator, which increases the likelihood of contamination of the insulating oil. Both, the process of manufacturing a radiation shield i.e., placing the shielding material on or along the insulating surface and soldering to the lead material to electrically ground the material are highly skilled operations.

Hence, there exists a need to provide a radiation shield that can be readily manufactured and sourced, while maintaining the insulating and radiation shielding properties.

BRIEF DESCRIPTION OF THE INVENTION

The above-mentioned drawbacks and limitations described above are addressed by the present invention.

In accordance with one embodiment, a radiation control apparatus for controlling transmission of electromagnetic radiation in a radiation generator is provided. The radiation control apparatus comprises a printed circuit board having a substrate layer, and at least one medium layer bound to the substrate layer. The printed circuit board is configured to control the transmission of the electromagnetic radiation in the radiation generator.

In accordance with another embodiment, a radiation generator is provided. The radiation generator comprises a radiation source, a power supply circuit electrically coupled to energize the radiation source so as to generate electromagnetic radiation, and at least one radiation control apparatus. The at least one radiation control apparatus includes at least one printed circuit board. The printed circuit board is configured to control the transmission of the electromagnetic radiation in the radiation generator.

In accordance with yet another embodiment, an X-ray generator comprising an X-ray tube, a power supply circuit electrically coupled to energize the X-ray tube, and a multiplier circuit board is provided. The multiplier circuit board is adapted to control the transmission of the electromagnetic radiation in the X-ray generator.

Systems and methods of varying scope are described herein. In addition to the aspects and advantages described in this summary, further aspects and advantages will become apparent by reference to the drawings and with reference to the detailed description that follows.

DETAILED DESCRIPTION OF THE INVENTION

In the following detailed description, reference is made to the accompanying drawings that form a part thereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
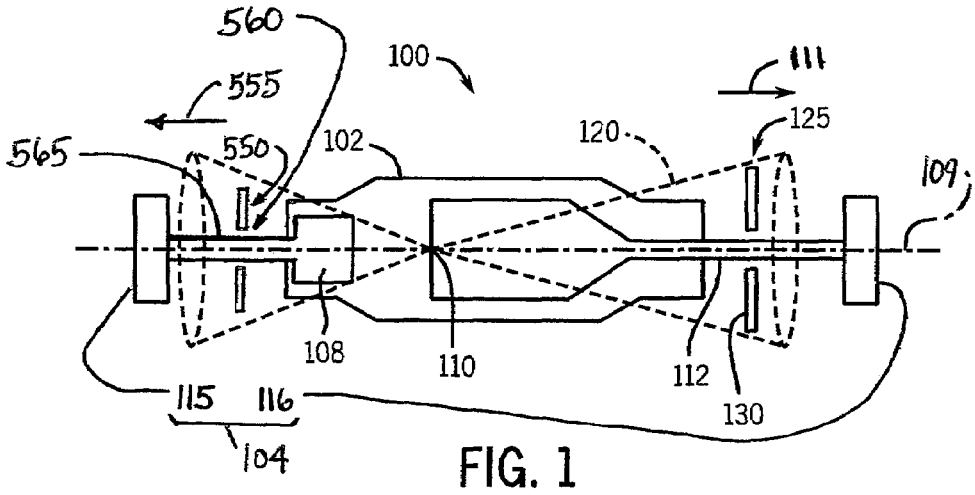
FIG. 1 shows a schematic diagram of an embodiment of a radiation generator having a radiation control apparatus that includes a printed circuit board.

FIG. 1 shows an embodiment of a radiation generator 100 that comprises a radiation source 102 configured to generate electromagnetic radiation. In the illustrated embodiment, the radiation generator 100 is an X-ray generator, and the radiation source 102 is an X-ray tube electrically coupled to a power supply circuit 104 so as to generate X-rays. The illustrated radiation source 102 generally includes a cathode 108 located, in general alignment along a central longitudinal axis 109 of the radiation source 102, opposite an anode 110.

The power supply circuit 104 generally includes one or more electrical components (e.g., diodes, capacitors, transformers, resistors, etc.) configured in a conventional manner to supply electrical power so as cause the emission of electromagnetic radiation (e.g., X-rays) from the radiation source 102. The illustrated power supply circuit 104 includes a first power circuit portion 115 electrically connected to the anode 110, and a second power circuit portion 116 electrically connected to the cathode 108. The first power circuit portion 115 for the anode 110 is located directly behind the anode 110 in an axial outward direction 111 from the anode 110 of the radiation source 102 opposite the cathode 108. The power circuit portion 116 is located in a similar manner behind the cathode 108. The first power circuit portion 105 of the power supply circuit 104 includes at least a conductor or cable 112 electrically coupled to provide a high voltage potential to the anode 110. The high voltage potential provided to the radiation source 102 is in the range of 40 to 100 kilovolts. However, the size of the voltage potential can vary.

The cathode 108 generally includes an electron-emitting filament that is capable in a conventional manner of emitting electrons. The high voltage potential supplied by the power supply circuit 104 causes acceleration of electrons from the cathode 108 towards the anode 110. The accelerated electrons collide with the anode 110, producing X-ray radiation. The cathode 108 and anode 110 reduce or partially attenuate the transmission of the electromagnetic radiation from the radiation source 102 in the zone 120. A shadow zone 120 represents an example of an expected range of partially attenuated electromagnetic radiation. The illustrated zone 120 is generally conical shaped, but the shape of the shadow zone 120 may vary.

The radiation generator 100 further includes a radiation control apparatus 125 configured to at least reduce and control the transmission of the electromagnetic radiation from the radiation source 102. The radiation control apparatus 125 generally includes at least one printed circuit board 130 placed between the radiation source 102 and the first power circuit portion 105 of the power supply circuit 104, within the shadow zone 120 where partially attenuated electromagnetic radiation or scattered radiation are expected, so as to reduce further and control the transmission of the electromagnetic radiation. The printed circuit board 130 can be sized to extend entirely across or at least partially across the zone 120 in a plane perpendicular to the longitudinal axis 109 of the radiation source 102. Also, the location of the radiation control apparatus 125 relative to the radiation source 102 can vary.

Figure 2:
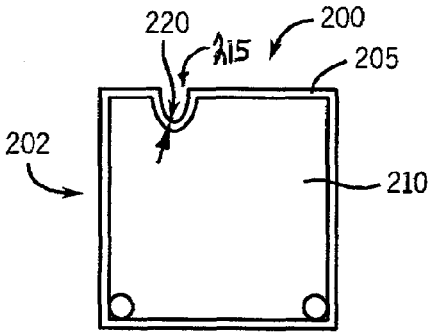
FIG. 2 shows a schematic diagram of an embodiment of a radiation control apparatus.

FIG. 2 provides a schematic diagram of one embodiment of a radiation control apparatus 200 comprised of a printed circuit board 202. The printed circuit board 202 includes a substrate layer 205 and a medium layer 210. The medium layer 210 can be bound to the substrate layer 205 using various processes, such as mechanical pressing, heating, pressurized spray, adhesives, or other conventional processes or combination thereof.

The substrate layer 205 is comprised of at least one insulating composition or a material selected from a group consisting of an epoxy compound, a urethane compound, a ceramic, and a silicon-potting compound. For example, the substrate layer 205 can include an epoxy laminated glass cloth sheet, also referred to as FR4. Yet, other types of insulating materials can be employed.

The medium layer 210 is comprised of a radio opaque material comprising at least one of a metal, a compound of a metal (such as a metal oxide, metal phosphate and metal sulphate), and an alloy of a metal or combination thereof. The medium layer 210 can be readily etched or soldered, and selected from a group comprising tungsten, calcium, tantalum, tin, molybdenum, brass, copper, strontium, chromium, aluminum and bismuth or a combination or a compound or an alloy thereof. However, it is understood that the composition of the medium layer 210 is not limited to the examples given above.

The printed circuit board 202 further includes an opening or conduit or slot 215 which provides passage for the conductor 112 from the power supply circuit 104 for electrical connection at the anode 110 of the radiation source 102 (See FIG. 1). The location of the opening 215 on the printed circuit board 202 can vary. A creepage distance 220 of the substrate layer 205 is provided between the conductor 112 and the medium layer 210 so as to reduce and control electrical stress and the likelihood of undesired electrical arcing between the conductor 112 of the first power circuit portion 105 of the power supply circuit 104 and the medium layer 210 of the printed circuit board 202. The manufacturing process of the printed circuit board 202 allows enhanced dimensional control for the construction, and placement of the medium layer 210 on the substrate layer 205 relative to the conductor 112.

The medium layer 210 can be an exposed, external layer or an intermediate, enclosed layer. The conductor 112 (See FIG. 1) can be butted against or at least be closely adjacent to the substrate layer 205 of the printed circuit board 202, yet at a predetermined spaced distance from contact with the medium layer 210 of the printed circuit board 202 so as to reduce opportunities of undesired electrical arcing. Locating the medium layer 210 externally of the printed circuit board 202 in the axially outward direction 111 (See FIG. 1) from the radiation source 102 allows greater thicknesses of the medium layer 210 to be employed, enhancing the radiation shielding effectiveness so as to reduce and control the transmission of radiation through the printed circuit board 202. The medium layer 210 of the printed circuit board 202 can be comprised of an integral, single layer or multiple layers of one or more radio opaque materials described above of varying thickness stacked together or overlapped in order to obtain a desired thickness of the medium layer 210 bound to the substrate layer 205. Although the illustrated medium layer 210 is bound at an external face of the substrate layer 205, it is understood that the subject mater described herein encompasses the medium layer 210 can be bound externally or internally embedded in the substrate 205.

Figure 3:
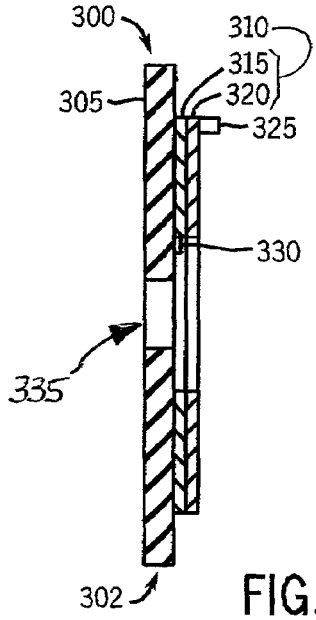
FIG. 3 shows a schematic diagram of another embodiment of a radiation control apparatus.

FIG. 3 illustrates another embodiment of a radiation control apparatus 300 that includes a printed circuit board 302 having a substrate layer 305 and a medium layer 310, similar in construction to the substrate layer 205 and the medium layer 210 of the printed circuit board 200 described above. The medium layer 310 is comprised of a series of medium layers 315 and 320 comprised of the same or a combination of radio opaque materials described above of varying thickness stacked together or at least partially overlapped in order to obtain a desired thickness of the medium layer 310. The medium layers 315 and 320 described above facilitate the mounting of one or more standard connectors 325 and 330 (e.g., clips, screws, etc.) configured to simplify the task of providing electrical or mechanical connections to the printed circuit board 302. The standard connectors 325 and 330 are configured to provide electrical connection to the conductor 112 (See FIG. 1), to extend electrical connections, or to provide electrical ground connections through the printed circuit board 300. For example, the conductor 112 (See FIG. 1) or portion thereof can extend through an opening 335, constructed similar to the opening 215 described above. The conductor 112 (See FIG. 1) can be electrically connected via the standard connectors 325 and 330 so as to provide electrical power from the first power circuit portion 105 of the power supply circuit 104 to the radiation source 102 (e.g., the X-ray tube). Each of the standard connectors 325 and 330 can be mounted on a same or at different medium layers 315 and 320. The location and type of the standard connectors 325 and 330 can vary. Also, although two medium layers 315 and 320 are shown, the number of the medium layers can vary.

Figure 4:
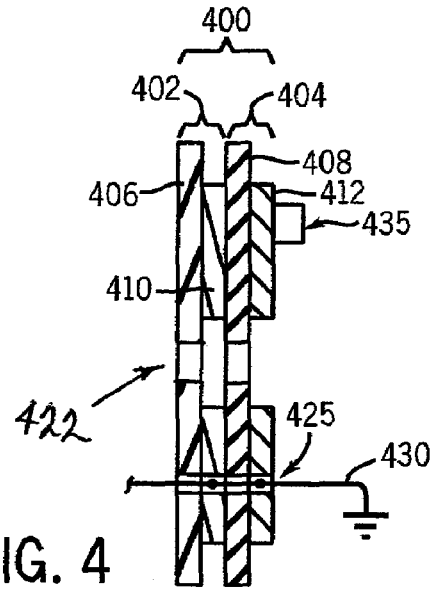
FIG. 4 shows a schematic diagram of yet another embodiment of a radiation control apparatus.

FIG. 4 illustrates another embodiment of a radiation control apparatus 400 comprised of multiple printed circuit boards 402 and 404. The printed circuit boards 402 and 404 are comprised of at least one substrate layer 406 and 408 and at least one medium layer 410 and 412, respectively, of varying thickness assembled together in various fashions to obtain a desired thickness, similar in construction to substrate layer 205 and medium layer 210 of the printed circuit board 200 described above. The at least one substrate layer 406 is arranged as an insulating surface facing and located nearest the radiation source 102. Constructing the radiation control apparatus 400 comprised of multiple printed circuit boards 402 and 404 such that the multiple medium layers 410 and 412 are separated by the substrate layers 406 and 408, respectively, allows each of the medium layers 410 and 412 to be maintained at a voltage potential different from one another and/or at a voltage potential different from an electrical ground. In addition to an opening 422 similar in construction to the opening 215 described above, to receive the conductor 112 therethrough, at least one of the printed circuit boards 402 and 404 includes at least one opening or point through hole (PTH) 425 configured to provide electrical or mechanical connection to one or more of the medium layers 410 and 412. For example, an electrical ground connection 430 can be received through the opening 425 for electrical connection to one or both of the medium layers 410 and 412 of the multiple printed circuit boards 402 and 404.

Still referring to FIG. 4, either of the printed circuit boards 402 and 404 can be mounted with one or more electrical components 435 (e.g., diodes, capacitors, resistors, transformers, etc.) of the first power circuit portion 105 of the power supply circuit 104 (See FIG. 1). It should be understood that the number and types of the electrical components 435 can vary. In addition to providing radiation shielding, the printed circuit boards 402 and 404 can be configured to provide electrical shielding so as regulate stray capacitance across one or more of the electrical components 435 mounted on the printed circuit boards 402 and 404.

Figure 5:
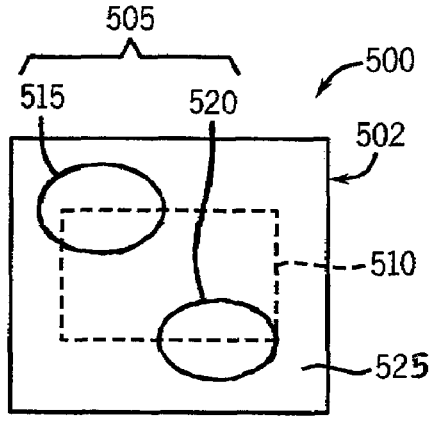
FIG. 5 shows schematic diagram of yet another embodiment of a radiation control apparatus.

FIG. 5 illustrates another embodiment of a radiation control apparatus 500 that includes a printed circuit board 502 comprised of multiple medium layers 505 and 510. A single medium layer 505 comprises multiple medium regions 515 and 520 that lie generally along a single plane perpendicular to the longitudinal axis 109 (See FIG. 1), yet spaced apart such that each can be at a different voltage potential from one another and/or at a different voltage potential from the electrical ground. The medium layer 510 is aligned in a plane spaced at a distance (e.g., by air, oil or a substrate layer 525) from the medium regions 515 and 520 of the medium layer 505. Yet, as shown in FIG. 5, each of the medium regions 515 and 520 are located in partial overlapping distribution relative to the medium layer 510 in looking in the axial outward direction 111 from the radiation source 102 (See FIG. 1). This embodiment of the radiation control apparatus 500 enhances electromagnetic radiation shielding while also allowing for multiple voltage potentials at the printed circuit board 502. It should be understood that the number and arrangement of the medium regions 515 and 520 at one or more of the medium layers 505 and 510 can vary.

Referring back to FIG. 1, a radiation control apparatus 550 can also be located in an axial outward direction (illustrated by arrow and reference 555) from the cathode 108 of the radiation source 102, similar to the radiation control apparatus 200. The radiation control apparatus 550 can be constructed and operated in a manner similar to one or more of the embodiments of radiation control apparatuses 200, 300, 400, and 500 or combination thereof described above. The radiation control apparatus 550 includes at least one opening 560, constructed in a manner similar to the opening 215 described above, configured to receive a conductor 565 from the second power circuit portion 106 to the cathode 108.

Figure 6:
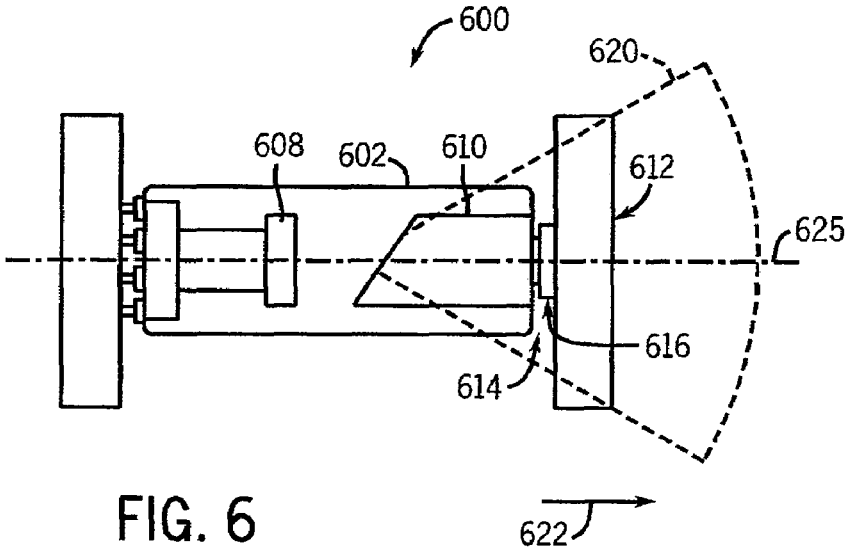
FIG. 6 shows a schematic diagram of another embodiment of a radiation generator having a radiation control apparatus that includes a multiplier circuit board.

FIG. 6 illustrates another embodiment of a radiation generator 600 that comprises a radiation source 602 (e.g., an X-ray tube) having a cathode 608 and anode 610 in combination with a power supply circuit 612 and a radiation control apparatus 614, similar to the radiation generator 100 described above. The radiation control apparatus 614 includes a multiplier circuit board 616 configured to reduce and control transmission of the electromagnetic radiation. The multiplier circuit board 616 is located within a shadow zone 620 representative of an expected range of attenuation of electromagnetic radiation, similar to the location of the printed circuit board 130 in the shadow zone 120 of the radiation generator 100 described above. The multiplier circuit board 616 is also located in an axially outward direction (shown by arrow and reference 622) from the anode 610 along a longitudinal axis 625 of the radiation source 602. Again, it should be understood that the multiplier circuit board 616 can be placed at other locations (e.g., axially outward of the cathode 608 opposite the radiation source 602) and can vary in size and shape.

Figure 7:
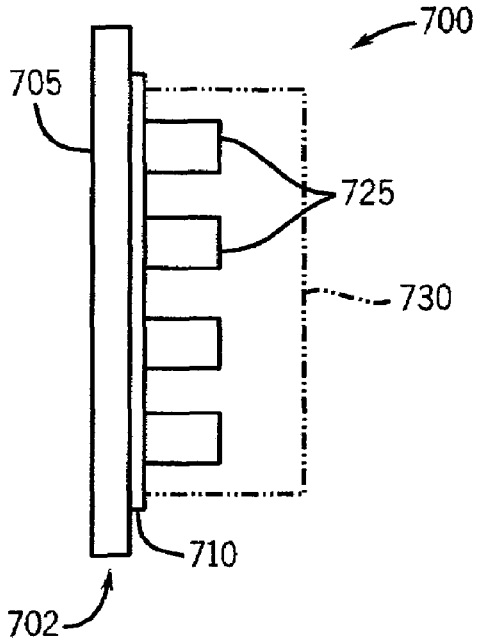
FIG. 7 shows a schematic diagram of an embodiment of the multiplier circuit board.

FIG. 7 shows a schematic diagram of an embodiment of a radiation control apparatus 700 that includes a multiplier circuit board 702. The multiplier circuit board 702 generally comprises at least one substrate layer 705, at least one medium layer 710 bound to the substrate layer 705, and multiple electrical components 725 of a multiplier circuit 730 electrically connected as part of or in addition to the power supply circuit 612 (See FIG. 6) in a manner so as to expand a range of voltage potentials communicated to the radiation source 602 of the radiation generator 600 (See FIG. 6). The electrical components 725 are attached in electrical connection with the at least one medium layer 710. In addition to enhancing radiation shielding, the multiplier circuit board 702 also enhances electrical shielding so as regulate electrical stray capacitance across the electrical components 725 of the multiplier circuit board 702.

Although FIG. 7 shows the multiplier circuit board 702 having a single medium layer 710, it is understood that the number of medium layers can vary, similar to the construction of the printed circuit board 202 described above. Also, although a single multiplier circuit board 702 is referenced and illustrated having the substrate layer 705 bound to the medium layer 710, it is understood that the multiplier circuit board 702 encompasses being comprised of multiple multiplier circuit boards 702 each having one or more substrate layers 705 separating one or more medium layers 710, so as to be able to maintain a voltage potential at one or more of the multiple medium layers 710 that is different from one another and/or different from the electrical ground, similar to the construction of the printed circuit board 402 described above. Likewise, the at least one medium layer 710 of the multiplier circuit board 702 can be comprised of multiple medium regions aligned along the same general plane and yet separated apart by the substrate layer in varying arrangements and fashions of construction (e.g., partial overlapping distribution, uniform stacked alignment, etc.), similar to the construction of the printed circuit board 502 described above.

Figure 8:
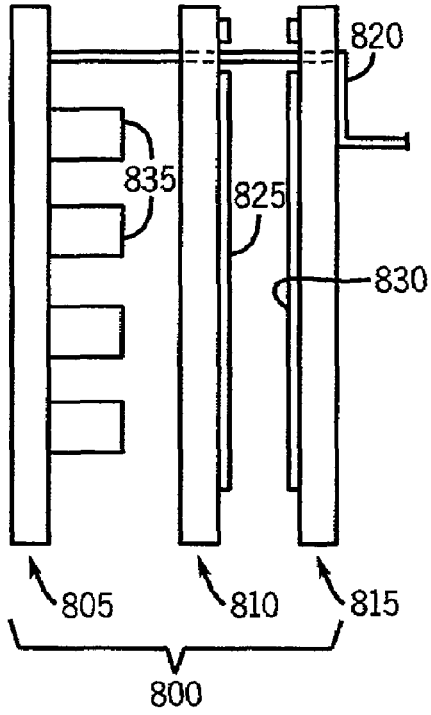
FIG. 8 shows a schematic diagram of an embodiment of a radiation control apparatus that includes a multiplier circuit board in combination with a printed circuit board.

FIG. 8 shows another embodiment of a radiation control apparatus 800 that includes at least one multiplier circuit board 805 combined with multiple printed circuit boards 810 and 815. The multiplier circuit board 805 is similar in construction to the multiplier circuit boards 616 and 702 described above. Likewise, the printed circuit boards 810 and 815 are similar in construction to the printed circuit boards 130, 202, 302, 402, and 502 described above and configured for reducing and controlling the emission or transmission of electromagnetic radiation. A conductor 820 electrically connects the power supply circuit 612 (See FIG. 6) and the radiation source 602 (See FIG. 6) in a manner as described above. The conductor 820 extends from the multiplier circuit board 805 through the printed circuit boards 810 and 815 for electrical connection at the radiation source 602 (See FIG. 6). Standard connectors 325 (See FIG. 3) can be provided to electrically connect the conductor 820 to one or more of the multiplier circuit board 805 and printed circuit boards 810 and 815. Medium layers 825 and 830 of the printed circuit boards 810 and 815, respectively, are oriented so as to face toward one another along the central longitudinal axis 109 (See FIG. 1). This configuration of the radiation control apparatus 800 not only enhances insulation and radiation shielding, but also controls communication of undesired stray electrical capacitance across electrical components 835 of a multiplier circuit 840 mounted at the multiplier circuit board 805. Again, it is understood that the number of multiplier circuit boards 805 and printed circuit boards 810 and 815 can vary.

Figure 9:
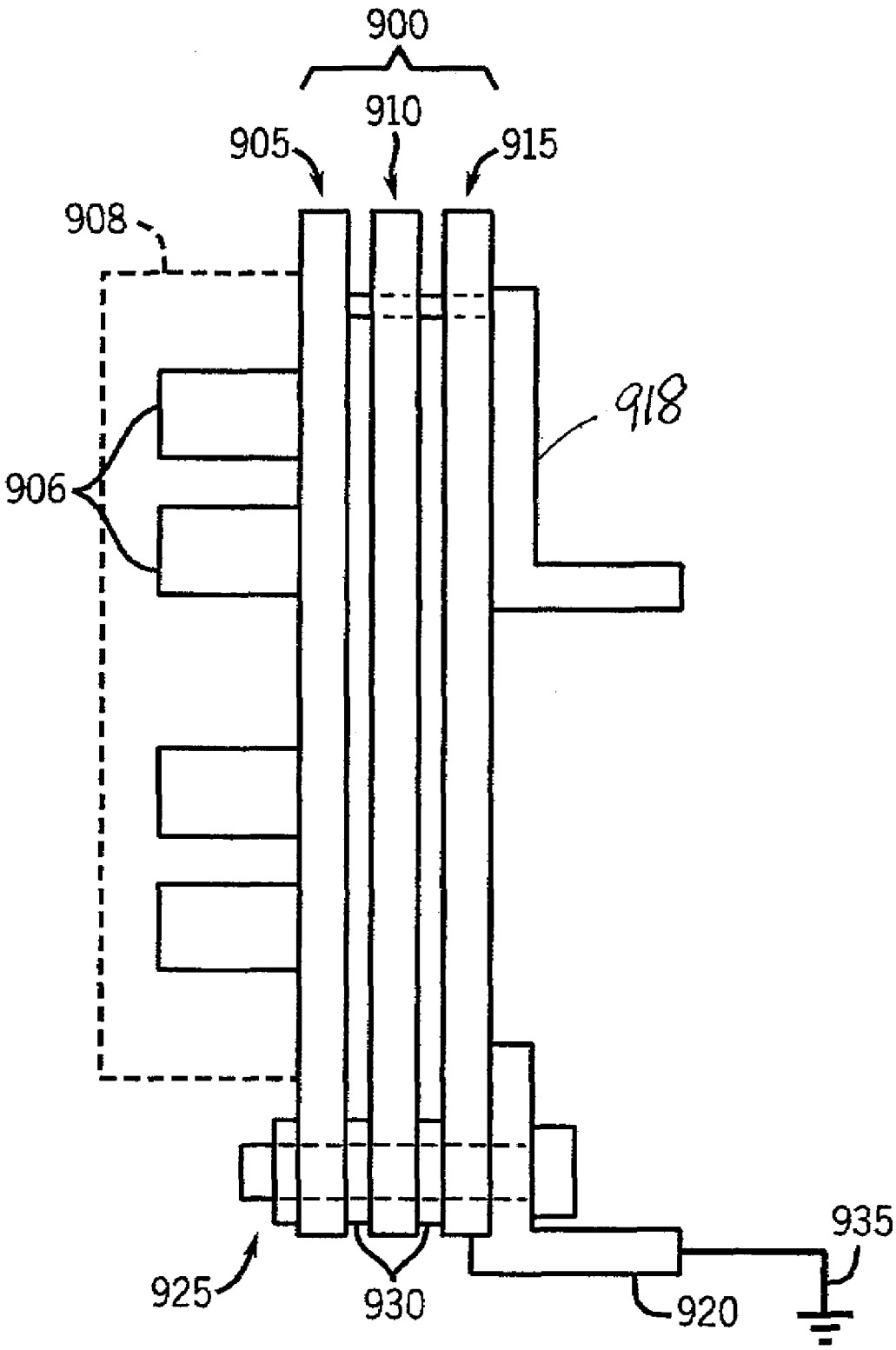
FIG. 9 shows a schematic diagram another embodiment of a radiation control apparatus that includes a multiplier circuit board in combination with a printed circuit board.

FIG. 9 shows another embodiment of a radiation control apparatus 900 which includes at least one multiplier circuit board 905 with miscellaneous electrical components 906 of a multiplier circuit 908, similar in construction to the multiplier circuit boards 616 and 702 described above, in combination with printed circuit boards 910 and 915, similar in construction to the printed circuit boards 130, 202, 302, 402, and 502 described above. A conductor 918 extends from the multiplier circuit board 905 through the printed circuit boards 910 and 915 so as to provide electrical power from the power supply circuit 612 (See FIG. 6) to the radiation source 602 (See FIG. 6). A metallic leg 920 in combination with a fastener 925 (e.g., bolt and nut) secures the multiplier circuit board 905 to the printed circuit boards 910 and 915. One or multiple washers 930 are located as spacers to provide separation between the at least one multiplier circuit board 905 and/or the printed circuit boards 910 and 915. The washers 930 also electrically connect one or more of the medium layers of the at least one multiplier circuit board 905 and printed circuit boards 910 and 915 at an electrical ground connection 935.

Still referring to FIG. 9, one or more of the miscellaneous electrical components 906 of the multiplier circuit 908 and/or the power supply circuit 612 (See FIG. 6) can be mounted in electrical connection on at least one of the printed circuit boards 910 and 915. The printed circuit boards 910 and 915 provide enhanced electrical shielding by regulating electrical stray capacitance across the electrical components 906. Moving one or more electrical components 906 of the multiplier circuit 908 and/or the power supply circuit 612 from the at least one multiplier circuit board 905 to one or more of the printed circuit boards 910 and 915 can also reduce the density, and thereby improve the associated thermal efficiency, of the radiation control apparatus 900.

Various embodiments of radiation control apparatuses 125, 200, 300, 400, 500, 614, 700, 800 and 900 configured to reduce, shield or control emission or transmission of electromagnetic radiation are described above in combination with radiation generators 100 and 600 having a radiation source 102 and 602, respectively. Although embodiments of the location of the radiation control apparatuses 125, 200, 300, 400, 500, 614, 700, 800 and 900 are shown, the embodiments are not so limited and the location of the radiation control apparatuses 125, 200, 300, 400, 500, 614, 700, 800 and 900 relative to the radiation source 102 and 602 can vary. Also, the embodiments of the radiation control apparatuses 125, 200, 300, 400, 500, 614, 700, 800 and 900 may be implemented in connection with different applications. The application of the radiation control apparatuses 125, 200, 300, 400, 500, 614, 700, 800 and 900 in radiation shielding can be extended to other areas or types of radiation generators. The radiation control apparatuses 125, 200, 300, 400, 500, 614, 700, 800 and 900 described above provide a broad concept of shielding various types of electromagnetic radiation. Further, the radiation control apparatuses 125, 200, 300, 400, 500, 614, 700, 800 and 900 can be used for mounting of miscellaneous electrical components 435, 725, 835 and 906 and in the regulation of stray capacitance across the miscellaneous electrical components 435, 725, 835 and 906, which can be adapted in various types of radiation generators 100 and 600.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radiation control apparatus adapted to control transmission of an electromagnetic radiation generated in a radiation generator, the radiation control apparatus comprising:

a printed circuit board having at least one substrate layer and at least one medium layer, wherein the printed circuit board is configured to control transmission of the electromagnetic radiation in the radiation generator, wherein the at least one medium layer includes a first medium layer attached to the at least one substrate layer, the first medium layer aligned in a respective different plane from a second medium layer generally perpendicular to a longitudinal axis of the radiation generator, the first and second medium layers located in partial overlapping distribution relative to one another in looking in a direction along the longitudinal axis, wherein the first and second medium layers are at an electrical potential not equal to electrical ground.

2. The radiation control apparatus of claim 1, wherein the at least one substrate layer is selected from a group consisting of an epoxy, a urethane and a silicon-potting compound.

3. The radiation control apparatus of claim 1, wherein the at least one medium layer includes a radio opaque material selected from a group consisting of tungsten, calcium, tantalum, tin, molybdenum, copper, brass, strontium, chromium, aluminum, and bismuth.

4. The radiation control apparatus of claim 1, wherein the radiation generator further comprises a radiation source and the first and second medium layers are located outward of a first substrate layer opposite the radiation source.

5. The radiation control apparatus of claim 1, wherein the first and second medium layers are each maintained at a voltage potential different from one another.

6. A radiation generator, comprising:

a radiation source operable to generate an electromagnetic radiation;

a power supply circuit electrically coupled to provide electrical power to energize the radiation source; and a radiation control apparatus to control transmission of electromagnetic radiation generated by the radiation source, the radiation control apparatus including at least one printed circuit board configured to control the transmission of the electromagnetic radiation in the radiation generators, wherein the at least one printed circuit board includes a first medium layer attached to an at least one substrate layer, the first medium layer aligned in a respective different plane from a second medium layer generally perpendicular to a longitudinal axis of the radiation generator, the first and second medium layers located in partial overlapping distribution relative to one another in looking in a direction along the longitudinal axis, wherein the first and second medium layers are at an electrical potential not equal to electrical ground.

7. The radiation generator of claim 6, wherein the at least one substrate layer includes a composition selected from a group consisting of an epoxy, a urethane and a silicon-potting compound.

8. The radiation generator of claim 6, wherein at least one of the first and second medium layers includes a radio opaque material selected from a group consisting of tungsten, calcium, tantalum, tin, molybdenum, brass, copper, strontium, chromium, aluminum, and bismuth.

9. The radiation generator of claim 6, wherein the power supply circuit comprises multiple electrical components, and wherein at least one electrical component of the power supply circuit is mounted on at least one the printed circuit board.

10. The radiation generator of claim 6, wherein the first medium layer is of a first material composition different from the second medium layer of a second material composition, the first material composition and the second material composition selected from a group consisting of a metal, a metal alloy, and a metal compound.

11. The radiation generator of claim 6, wherein the radiation control apparatus further includes a multiplier circuit board aligned in a plane in general parallel alignment to the at least one printed circuit board and attached to one another by a fastener, the multiplier circuit board mounted with at least one electrical component of a multiplier circuit operable to extend a range of voltage potential provided by the power supply circuit to the radiation source.

12. The radiation generator of claim 11, further including a washer located between the multiplier circuit board and the at least one printed circuit board, the washer providing an electrical connection between the multiplier circuit board and the fastener.

13. The radiation generator of claim 6, wherein at least one of the first and second medium layers is spaced at a creepage distance from contact with a conductor of the power supply circuit passing through.

14. An X-ray generator, comprising:

an X-ray tube;

a power supply circuit electrically coupled to energize the X-ray tube; and a multiplier circuit board configured to control transmission of an electromagnetic radiation in the X-ray generator, the multiplier circuit board having at least one medium layer and at least one substrate layer, the at least one medium layer including a first medium layer attached to the at least one substrate layer, the first medium layer aligned in a respective different plane from a second medium layer generally perpendicular to a longitudinal axis of the radiation generator, the first and second medium layers located in partial overlapping distribution relative to one another in looking in a direction along the longitudinal axis, wherein the first and second medium layers are at an electrical potential not equal to electrical ground.

15. The X-ray generator of claim 14, wherein the at least one substrate layer is comprised of a material selected from a group consisting of an epoxy, a urethane and a silicon-potting compound.

16. The X-ray generator of claim 14, wherein the at least one medium layer includes a radio opaque material selected from a group consisting of tungsten, calcium, tantalum, tin, molybdenum, brass, copper, strontium, chromium, aluminum, and bismuth.

17. The X-ray generator of claim 14, wherein the at least one medium layer is spaced at a creepage distance from contact with a conductor of the power supply circuit passing through.

* * * * *